US008963977B2

(12) United States Patent
Furuta

(10) Patent No.: US 8,963,977 B2
(45) Date of Patent: Feb. 24, 2015

(54) IMAGE FORMING APPARATUS THAT INCLUDES A PLURALITY OF LIGHT EMITTING ELEMENTS ARRAYED SO AS TO EXPOSE DIFFERENT POSITIONS IN A LONGITUDINAL DIRECTION OF A PHOTOSENSITIVE MEMBER AND CONFIGURED TO CONTROL A LIGHT AMOUNT OF A LIGHT EMITTED FROM THE PLURALITY OF LIGHT EMITTING ELEMENTS

(71) Applicant: Canon Kabushiki Kaisha, Tokyo (JP)

(72) Inventor: Yasutomo Furuta, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/921,800

(22) Filed: Jun. 19, 2013

(65) Prior Publication Data

US 2013/0342627 A1 Dec. 26, 2013

(30) Foreign Application Priority Data

Jun. 26, 2012 (JP) ..... 2012-143142

(51) Int. Cl.

| | |
|---|---|
| ***B41J 2/435*** | (2006.01) |
| ***G03G 13/04*** | (2006.01) |
| ***G03G 13/01*** | (2006.01) |
| ***B41J 2/45*** | (2006.01) |
| *G03G 15/043* | (2006.01) |

(52) U.S. Cl.

CPC ..... *G03G 13/04* (2013.01); *G03G 13/01* (2013.01); *B41J 2/451* (2013.01); *G03G 15/043* (2013.01); *G03G 2215/0409* (2013.01)

USPC ..... 347/236; 347/246

(58) Field of Classification Search

USPC ..... 347/116, 229, 234–237, 246–250

See application file for complete search history.

(56) References Cited

U.S. PATENT DOCUMENTS

| | | | | |
|---|---|---|---|---|
| 7,485,886 | B2 * | 2/2009 | Nakajima | 250/553 |
| 2005/0263718 | A1 * | 12/2005 | Tsujino et al. | 250/483.1 |
| 2007/0040775 | A1 * | 2/2007 | Horisaki et al. | 345/82 |

FOREIGN PATENT DOCUMENTS

| | | | | |
|---|---|---|---|---|
| JP | 04267276 A | * | 9/1992 | B41J 2/44 |
| JP | 2007-62020 A | | 3/2007 | |

* cited by examiner

*Primary Examiner* — Hai C Pham

(74) *Attorney, Agent, or Firm* — Canon USA, Inc. IP Division

(57) ABSTRACT

An image forming apparatus includes a light source including a plurality of light emitting elements for emitting a light beam for exposing the photosensitive member, the light emitting elements being arranged respectively corresponding to one pixel of the image in a direction of a rotational axis of the photosensitive member, an output unit for outputting pixel data for driving each of the light emitting elements, a drive unit for driving the light emitting elements based on the output pixel data, a storage unit for storing a cumulative number of times of light emission of a target light emitting element included in the light emitting elements, and a light amount control unit for controlling a light amount of a light beam emitted by the target light emitting element and the other light emitting elements based on the stored cumulative number of times of light emission of the target light emitting element.

14 Claims, 7 Drawing Sheets

| | | | | | | | | | | | | | | | | | | | | | | | | | | |
|---|---|---|---|---|---|---|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 1 | 0 | 0 | 0 | 0 | 0 | 0 | 0 | 0 | 0 | PIXEL DATA FOR FIRST SHEET |
| 0 | 0 | 0 | 0 | 0 | 0 | 0 | 0 | 0 | 0 | 0 | 0 | 0 | 0 | 0 | 0 | 1 | 0 | 0 | 0 | 0 | 0 | 0 | 0 | 0 | 0 | 0 | PIXEL DATA FOR SECOND SHEET |
| 0 | 0 | 0 | 0 | 0 | 0 | 0 | 0 | 0 | 0 | 0 | 0 | 0 | 0 | 0 | 1 | 0 | 0 | 0 | 0 | 0 | 0 | 0 | 0 | 0 | 0 | 0 | PIXEL DATA FOR THIRD SHEET |
| 0 | 0 | 0 | 0 | 0 | 0 | 0 | 0 | 0 | 0 | 0 | 0 | 0 | 0 | 1 | 0 | 0 | 0 | 0 | 0 | 0 | 0 | 0 | 0 | 0 | 0 | 0 | PIXEL DATA FOR FOURTH SHEET |
| 0 | 0 | 0 | 0 | 0 | 0 | 0 | 0 | 0 | 0 | 0 | 0 | 0 | 1 | 0 | 0 | 0 | 0 | 0 | 0 | 0 | 0 | 0 | 0 | 0 | 0 | 0 | PIXEL DATA FOR FIFTH SHEET |
| 0 | 0 | 0 | 0 | 0 | 0 | 0 | 0 | 0 | 0 | 0 | 0 | 1 | 0 | 0 | 0 | 0 | 0 | 0 | 0 | 0 | 0 | 0 | 0 | 0 | 0 | 0 | PIXEL DATA FOR SIXTH SHEET |
| 0 | 0 | 0 | 0 | 0 | 0 | 0 | 0 | 0 | 0 | 0 | 1 | 0 | 0 | 0 | 0 | 0 | 0 | 0 | 0 | 0 | 0 | 0 | 0 | 0 | 0 | 0 | PIXEL DATA FOR SEVENTH SHEET |
| 0 | 0 | 0 | 0 | 0 | 0 | 0 | 0 | 0 | 0 | 1 | 0 | 0 | 0 | 0 | 0 | 0 | 0 | 0 | 0 | 0 | 0 | 0 | 0 | 0 | 0 | 0 | PIXEL DATA FOR EIGHTH SHEET |
| 0 | 0 | 0 | 0 | 0 | 0 | 0 | 0 | 0 | 1 | 0 | 0 | 0 | 0 | 0 | 0 | 0 | 0 | 0 | 0 | 0 | 0 | 0 | 0 | 0 | 0 | 0 | PIXEL DATA FOR NINTH SHEET |

IMAGE FORMING APPARATUS THAT INCLUDES A PLURALITY OF LIGHT EMITTING ELEMENTS ARRAYED SO AS TO EXPOSE DIFFERENT POSITIONS IN A LONGITUDINAL DIRECTION OF A PHOTOSENSITIVE MEMBER AND CONFIGURED TO CONTROL A LIGHT AMOUNT OF A LIGHT EMITTED FROM THE PLURALITY OF LIGHT EMITTING ELEMENTS

BACKGROUND OF THE INVENTION

1. Field of the Invention

One disclosed aspect of the embodiments relates to an image forming apparatus that includes a plurality of light emitting elements arrayed so as to expose different positions in a longitudinal direction of a photosensitive member.

2. Description of the Related Art

An electrophotographic image forming apparatus that uses a light-emitting diode (LED) as a light source to expose a photosensitive member has been known. Such an image forming apparatus includes an exposure head that includes a plurality of LEDs arrayed in a longitudinal direction of the photosensitive member, so that one pixel is formed by each LED. The number of arrayed light emitting elements is determined based on the width and the resolution of the image forming area in the longitudinal direction of the photosensitive member. For example, for a 1,200 dpi printer, since the interval between pixels is about 21.1 μm (truncated to one decimal place), the light emitting elements are arranged so that the interval between adjacent light emitting elements forming pixels is 21.1 μm. Since such an LED exposure type image forming apparatus does not require a polygon mirror, reducing the size of the apparatus and reducing costs is easier, compared with a light beam scanning type image forming apparatus that uses a polygon mirror.

On the other hand, an LED exposure system suffers from the problem that when there is unevenness in the light amount of the respective LEDs, image defects such as streaks are produced in the rotation direction of the photosensitive member. To suppress such unevenness in the light amount of the LEDs, light amount adjustment is performed for each LED before shipment.

Further, LEDs also suffer from light amount deterioration, in which the amount of emitted light deteriorates over time. Consequently, if the usage frequency (cumulative number of times of light emission and cumulative duration of light emission) is different among the LEDs, a difference occurs in the level of deterioration among the LEDs, which results in unevenness in the amount of emitted light. For example, when the user prints a large quantity of the same image for a long period, or when a formulaic image of a line (ruled line etc.) along the rotation direction of the photosensitive member is included in the print image, a difference in the usage frequency of the LEDs occurs based on the output image, which results in a difference in the amount of emitted light of the LEDs.

To suppress the unevenness in the amount of emitted light that occurs due to differences in the usage frequency of each LED, Japanese Patent Application Laid-Open No. 2007-62020 discusses an image forming apparatus that stores data relating to the usage frequency of each LED (cumulative number of times of light emission or cumulative duration of light emission), and controls the light amount of each LED based on that data.

However, in Japanese Patent Application Laid-Open No. 2007-62020, a memory for storing the data relating to the usage frequency of the LEDs needs to be provided for all the LEDs. Specifically, Japanese Patent Application Laid-Open No. 2007-62020 suffers from the drawback that a large-capacity memory has to be provided.

SUMMARY OF THE INVENTION

According to an aspect of the embodiments, an image forming apparatus configured to form an image on a recording medium by forming an electrostatic latent image on a rotating photosensitive member, developing the electrostatic latent image with toner, and transferring a toner image developed with toner from the photosensitive member onto the recording medium, includes a light source that includes a plurality of light emitting elements configured to emit a light beam for exposing the photosensitive member, wherein the plurality of light emitting elements are arranged so as to respectively correspond to one pixel of the image in a direction of a rotational axis of the photosensitive member, an output unit configured to output pixel data for driving each of the plurality of light emitting elements, a drive unit configured to drive the plurality of light emitting elements based on the pixel data output from the output unit, a storage unit configured to store a cumulative number of times of light emission of a target light emitting element included in the plurality of light emitting elements, and a light amount control unit configured to control a light amount of a light beam emitted by the target light emitting element and the light emitting elements other than the target light emitting element based on the stored cumulative number of times of light emission of the target light emitting element.

According to another aspect of the embodiments, an image forming apparatus configured to form an image on a recording medium by forming an electrostatic latent image on a rotating photosensitive member, developing the electrostatic latent image with toner, and transferring a toner image developed with toner from the photosensitive member onto the recording medium, includes a light source that includes a plurality of light emitting elements configured to emit a light beam for exposing the photosensitive member, wherein the plurality of light emitting elements are arranged so as to respectively correspond to one pixel of the image in a direction of a rotational axis of the photosensitive member, an output unit configured to output pixel data for driving each of the plurality of light emitting elements, a drive unit configured to drive the plurality of light emitting elements based on the pixel data output from the output unit, a storage unit configured to store a cumulative duration of light emission of a target light emitting element included in the plurality of light emitting elements, and a light amount control unit configured to control a light amount of a light beam emitted by the target light emitting element and the light emitting elements other than the target light emitting element based on the cumulative duration of light emission of the target light emitting element stored in the storage unit.

Further features of the disclosure will become apparent from the following description of exemplary embodiments with reference to the attached drawings.

DESCRIPTION OF THE EMBODIMENTS

An exemplary embodiment of the disclosure will now be described based on a color image forming apparatus that forms images using a plurality of toner colors as an example. However, the exemplary embodiment is not limited to a color image forming apparatus. For example, the present exemplary embodiment may be applied to an image forming apparatus that forms images using only a single toner color (e.g., black). One disclosed feature of the embodiments may be described as a process which is usually depicted as a flowchart, a flow diagram, a structure diagram, or a block diagram. Although a flowchart may describe the operations as a sequential process, many of the operations may be performed in parallel or concurrently. In addition, the order of the operations may be re-arranged. A process is terminated when its operations are completed. A process may correspond to a method, a program, a procedure, a method of manufacturing or fabrication, etc. One embodiment may be described by a schematic drawing depicting a physical structure. It is understood that the schematic drawing illustrates the basic concept and may not be scaled or depict the structure in exact proportions.

(Overall Configuration of the Image Forming Apparatus)

Figure 1:
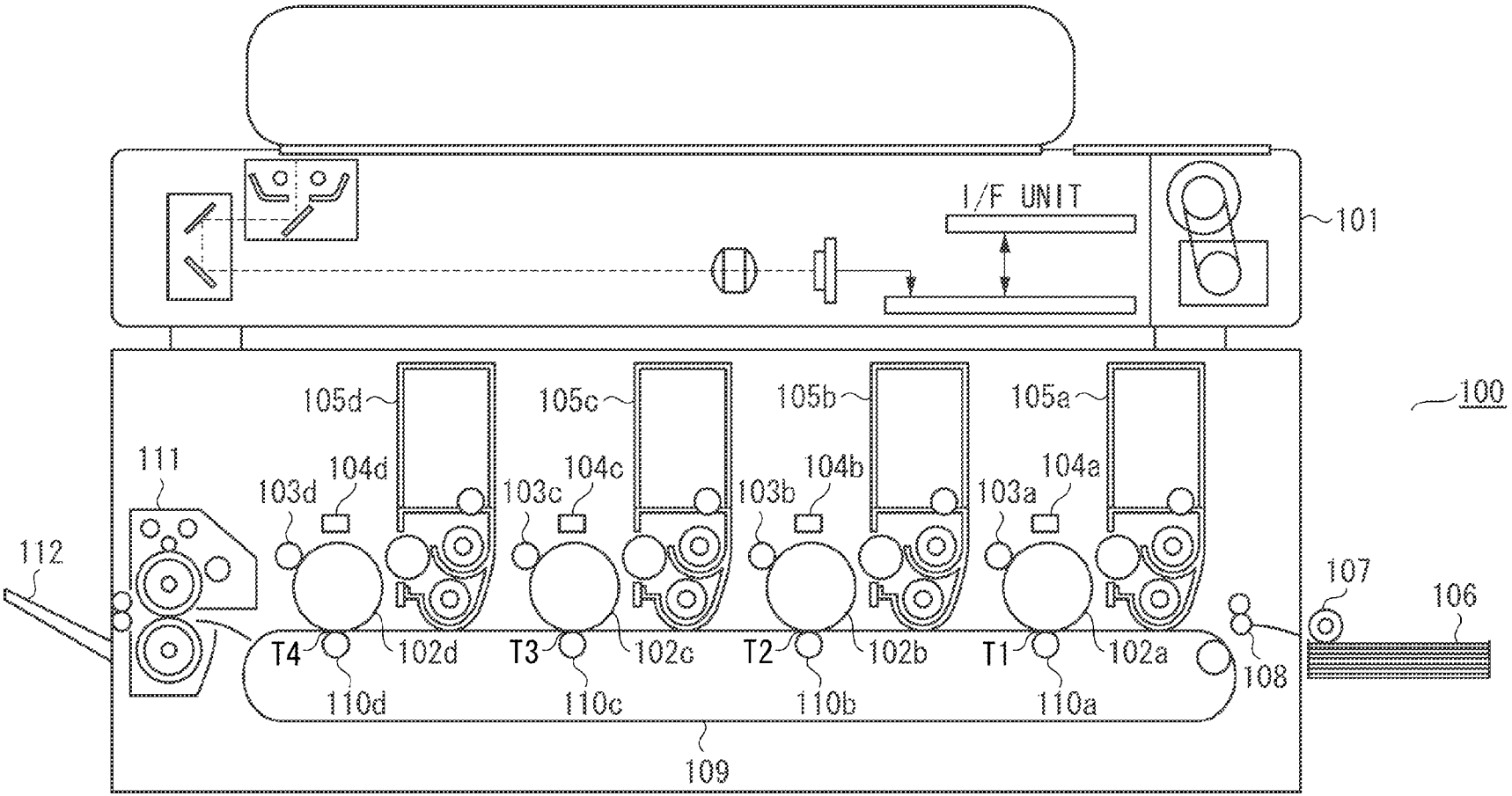
FIG. 1 is a schematic cross-sectional view of a color image forming apparatus.

FIG. 1 is a schematic cross-sectional view of a color image forming apparatus (hereinafter "image forming apparatus 100"). The image forming apparatus 100 according to the present exemplary embodiment includes a reading apparatus 101. The reading apparatus 101 irradiates a document placed on a platen with light, reads reflected light from the document, and generates image data by converting that image into an electric signal.

The image forming apparatus 100 includes photosensitive drums 102*a*, 102*b*, 102*c*, and 102*d*, which are photosensitive members. Photosensitive drum 102*a* is charged by a charging roller 103*a*. Photosensitive drum 102*b* is charged by a charging roller 103*b*. Photosensitive drum 102*c* is charged by a charging roller 103*c*. Photosensitive drum 102*d* is charged by a charging roller 103*d*.

The image forming apparatus 100 includes exposure heads 104*a*, 104*b*, 104*c*, and 104*d*, which are exposure light sources that include a plurality of light emitting elements that output light beams for exposing the photosensitive drums 102*a*, 102*b*, 102*c*, and 102*d*, respectively, based on the image data. The photosensitive drums charged by the respective charging rollers are exposed by the light beams emitted from the respective exposure heads, thereby forming an electrostatic latent image based on the image data.

The electrostatic latent image formed on the photosensitive drum 102*a* is developed by a development device 105*a* using a yellow toner image, the electrostatic latent image formed on the photosensitive drum 102*b* is developed by a development device 105*b* using a magenta toner image, the electrostatic latent image formed on the photosensitive drum 102*c* is developed by a development device 105*c* using a cyan toner image, and the electrostatic latent image formed on the photosensitive drum 102*d* is developed by a development device 105*d* using a black toner image.

The image forming apparatus 100 includes a sheet cassette 106 that contains a recording medium, such as recording paper. The recording paper contained in the sheet cassette 106 is conveyed sheet by sheet to a pair of conveyance rollers 108 by a feeding roller 107, and conveyed onto a conveyance belt 109 by the pair of conveyance rollers 108. The recording paper conveyed onto the conveyance belt 109 is conveyed to a transfer nip portion T1 (transfer portion T1) formed by the photosensitive drum 102*a* and a transfer roller 110*a*. The yellow toner image on the photosensitive drum 102*a* at the transfer nip portion T1 is transferred onto the recording paper. Then, the recording paper on which the yellow toner image has been transferred is successively conveyed to a transfer nip portion T2 formed by the photosensitive drum 102*b* and a transfer roller 110*b*, a transfer nip portion T3 formed by the photosensitive drum 102*c* and a transfer roller 110*c*, and a transfer nip portion T4 formed by the photosensitive drum 102*d* and a transfer roller 110*d*, so that the respective toner images on the photosensitive drums at the transfer nip portions are transferred onto the recording paper.

The recording paper on which the respective color toner images have been transferred is conveyed to a fixing device 111, and the toner images on the recording paper are fixed. The recording paper that has passed through the fixing device 111 is conveyed to a discharge tray 112.

(Exposure Head Configuration)

Next, exposure heads 104*a*, 104*b*, 104*c*, and 104*d* will be described. Since the exposure heads each have the same configuration, the following description will use the abbreviated terms "exposure head 104" and "photosensitive drum 102" exposed by the exposure head 104.

Figure 2A:
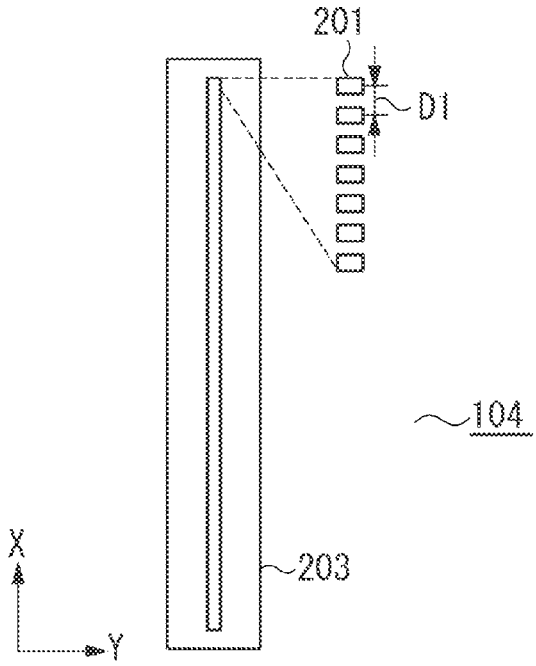
FIG. 2A is a schematic cross-sectional view of an exposure head, and 2B is a schematic cross-sectional view of an exposure head and a photosensitive drum.
Figure 2B:
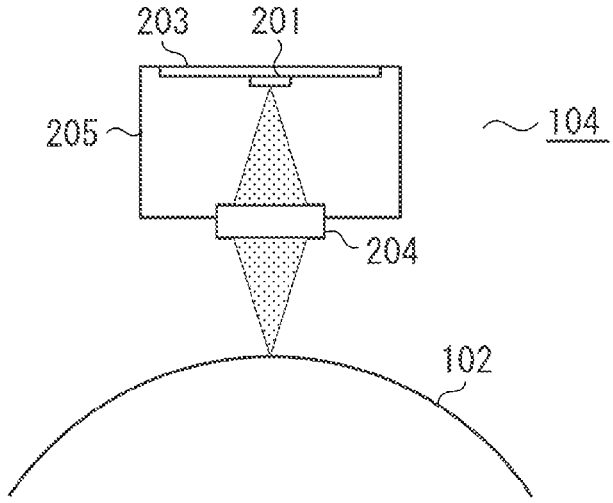

FIG. 2A is a schematic cross-sectional view of the exposure head 104, and FIG. 2B is a schematic cross-sectional view of the exposure head 104 and the photosensitive drum 102. The exposure head 104 includes a plurality of light-emitting diodes (LEDs), which are light emitting elements. In FIG. 2A, the X axis direction is the direction of the rotational axis (longitudinal direction) of the photosensitive drum 102, and the Y axis direction is the rotational direction of the photosensitive drum 102.

The plurality of LEDs are respectively arranged in an array in the X axis direction so as to expose different positions in the direction of the rotational axis of the photosensitive drum 102. An interval D1 between adjacent LEDs corresponds to the resolution of the image forming apparatus. For example, since the interval between adjacent pixels in an image formed by an image forming apparatus having a resolution of 1,200 dpi is about 21.1 μm, the plurality of LEDs is arranged so that the interval D1 between adjacent LEDs is about 21.1 μm.

As illustrated in FIG. 2B, the exposure head 104 includes a plurality of LEDs 201, a printed circuit board 203 on which the plurality of LEDs 201 is mounted, a rod-lens array 204, and a frame 205 that holds the printed circuit board 203 and the rod-lens array 204. In the factory, the exposure head 104 is individually assembled and adjusted, and the focus and initial light amount at a spot corresponding to the photosensitive drum surface of the light beam emitted from each LED are adjusted. The initial light amount adjustment is performed in the factory so that the light amount of the LEDs before shipment is to be a target light amount.

The exposure head that has been subjected to focus adjustment and initial light amount adjustment is installed in the image forming apparatus 100. The exposure head 104 is installed in the image forming apparatus 100 so that the distance between the photosensitive drum 102 and the rod-lens array 204 is the same as the distance between the rod-lens array 204 and the plurality of LEDs 201. Consequently, the focus adjustment is performed by adjusting the installation position with respect to the frame 205 of the rod-lens array 204 so that the distance between the rod-lens array 204 and the plurality of LEDs 201 is to be a desired value. Further, the initial light amount adjustment is performed by adjusting the drive current supplied to each LED. Specifically, each LED is successively made to emit light, and the drive current (initial drive current I) initially supplied to each LED is adjusted for each LED so that the light amount of the light beam that passes through the rod-lens array 204 and is collected at a position corresponding to the photosensitive drum 102 surface is to be a target light amount (initial light amount).

(LED Light Amount Control)

Next, the light amount control of the light beam emitted by the LEDs will be described with reference to FIG. 3 and FIGS. 4A and 4B. This LED light amount control is a control operation that is executed by the image forming apparatus, after shipping from the factory, to set the light amount of the light beam emitted from the LEDs in forming an image to a target light amount.

Figure 3:
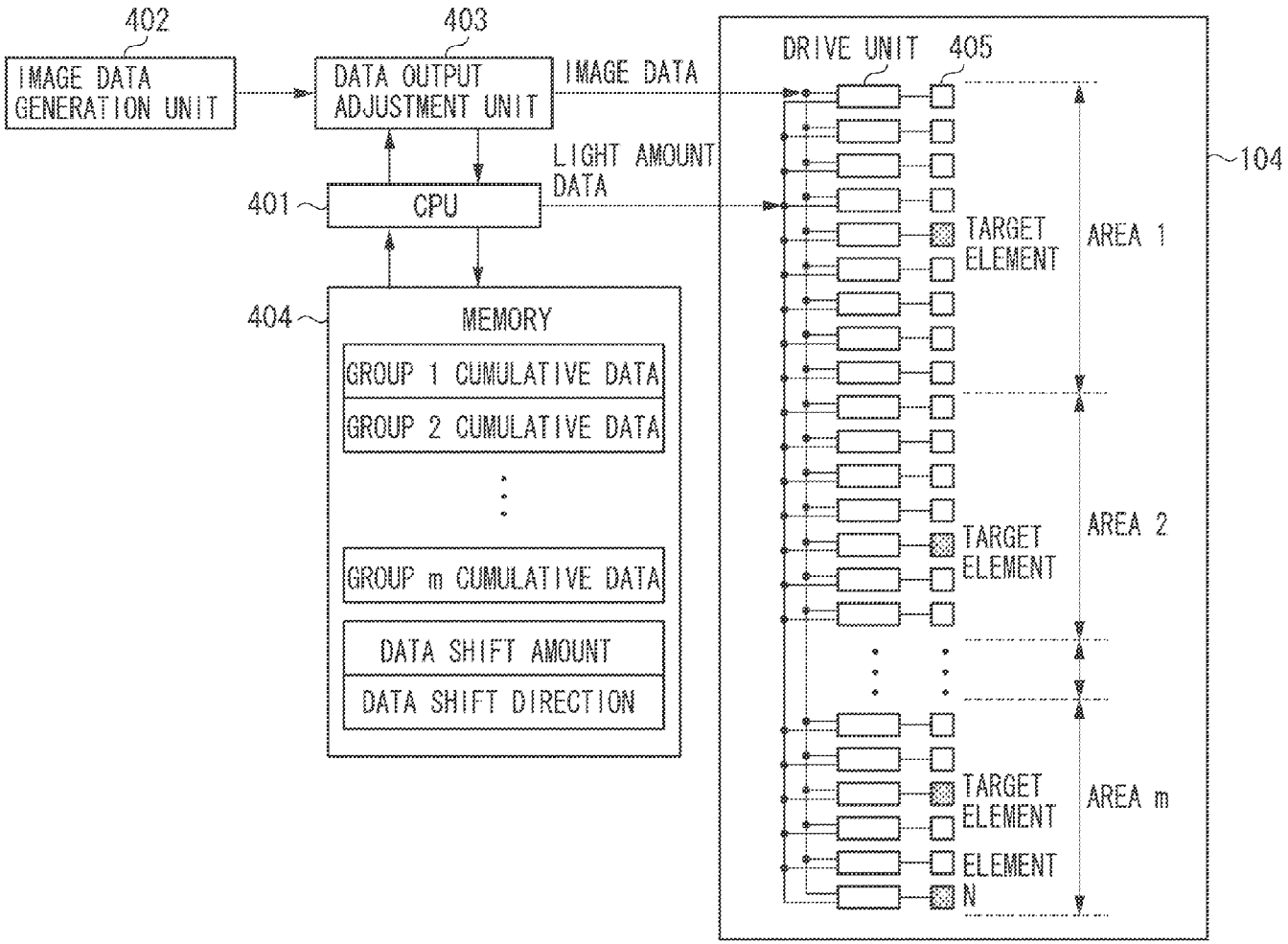
FIG. 3 is a control block diagram of a color image forming apparatus.

FIG. 3 is a control block diagram of the image forming apparatus according to the present exemplary embodiment. As illustrated in FIG. 3, a plurality of LEDs arranged in an array are divided into a plurality of groups in the LED array direction, such as an LED group arrayed in an area 1, an LED group arrayed in an area 2, . . . and an LED group arrayed in an area m. In the present exemplary embodiment, the LED group arrayed in an area X (X≥1) is referred to as the LED group belonging to group X.

A plurality of LEDs belong to each group, and the number of LEDs belonging to each group is the same. In the present exemplary embodiment, nine LEDs belong to each group. In each group, a target light emitting element (target LED) is set. In the image forming apparatus according to the present exemplary embodiment, the LED positioned in the center of the nine LEDs belonging to each group is set as the target LED.

The image forming apparatus 100 according to the present exemplary embodiment includes a central processing unit (CPU) 401, a data generation unit 402, a data output adjustment unit 403 (output control unit), a memory 404, and a drive unit 405.

The drive unit 405, which is individually provided for each of the plurality of LEDs, drives the corresponding LED based on the input pixel data.

The data generation unit 402 generates binary pixel data for driving each LED based on the image data input by the reading apparatus 101 or an external information terminal, such as a personal computer (PC). Specifically, based on the image data, the data generation unit 402 generates either pixel data (pixel data "1") that makes an LED emit light or pixel data (pixel data "0") that does not make an LED emit light. The data generation unit 402 outputs the generated pixel data to the data output adjustment unit 403. The data output adjustment unit 403 performs adjustment to determine which of the plurality of the drive units 405 each of the plurality of pixel data input from the data generation unit 402 is to be output to, based on an instruction from the CPU 401.

The memory 404 stores data relating to a cumulative number of times of light emission by the target LED belonging to each group and a lookup table in which data relating to a cumulative number of times of light emission by the target LED belonging to each group is associated with a drive current value supplied to the LED. Alternatively, the memory 404 stores a correction calculation formula. Further, the memory 404 stores data relating to a below-described data shift amount and data shift direction.

The CPU 401 reads data from the memory 404 and updates the data stored in the memory 404. Further, the CPU 401 includes a number of internal counters (not illustrated) equal to the number of below-described target LEDs, and increases the count value based on the output of pixel data from the data output adjustment unit 403 to the drive units 405 driving each of the target LEDs.

Figure 4A:
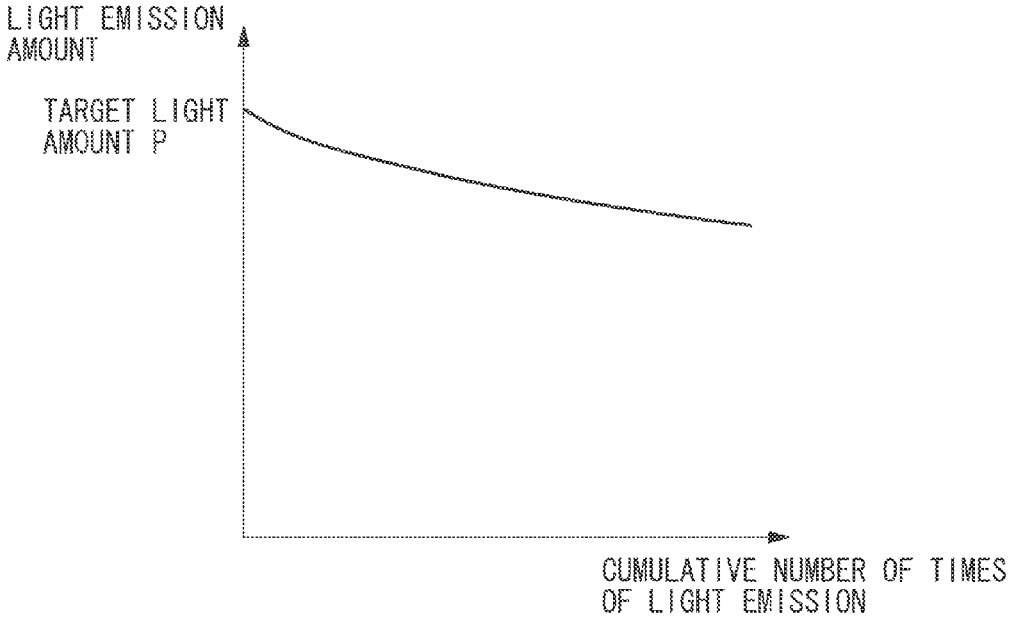
FIG. 4A illustrates changes in light amount emitted from an LED according to a cumulative number of times of light emission when a constant drive current is supplied to an LED.

FIG. 4A illustrates changes in light amount emitted from an LED according to a cumulative number of times of light emission when a constant drive current is supplied to an LED. The horizontal axis in FIG. 4A represents the cumulative number of times of light emission, and the vertical axis represents the light amount of the light beam emitted from the LED. During the acquisition of data illustrated in FIG. 4A, the LED emits a light beam for a period corresponding to one pixel based on the pixel data, then switches off. This emission of light is counted as one light emission. As illustrated in FIG. 4A, the light amount emitted from the LED due to the supply of a drive current decreases from a target light amount P (the initial light amount) as the cumulative number of times of light emission by the LED increases.

As described above, when installing the LEDs in the image forming apparatus, an initial value (the above-described initial drive current I) for the drive current supplied to the LEDs is set so that the light beam that is emitted from the LEDs is to be a target light amount (initial light amount). However, as illustrated in FIG. 4A, the light amount of the light beam that is emitted from the LEDs decreases according to the cumulative number of times of light emission. Consequently, there is a need to suppress the deterioration in density by increasing the drive current supplied to the LEDs according to the cumulative number of times of light emission.

Figure 4B:
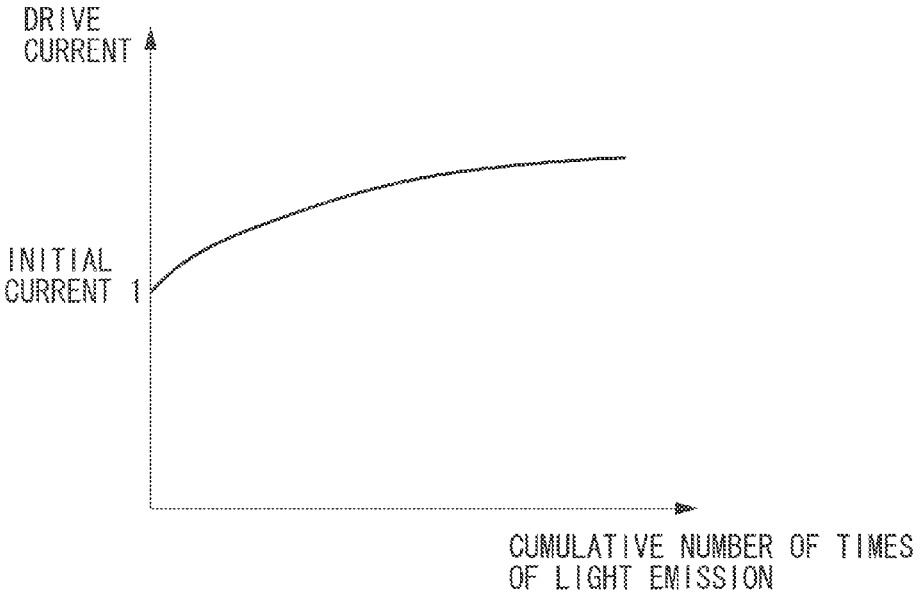
FIG. 4B is a lookup table in which a cumulative number of times of light emission of an LED is associated with a drive current value supplied to an LED.

To solve this problem, the memory 404 according to the present exemplary embodiment includes the lookup table illustrated in FIG. 4B, in which the cumulative number of times of light emission of the LED is associated with the drive current value supplied to the LED. The CPU 401 suppress the deterioration in density by performing light amount control of the LED using the lookup table. The horizontal axis in FIG. 4B represents the cumulative number of times of light emission, and the vertical axis represents the drive current value supplied to the LED. As illustrated in FIG. 4B, the decrease in the light amount of the LED from the initial light amount can be suppressed by increasing, from the initial drive current I, the drive current value supplied to the LED according to the increase in the cumulative number of times of light emission.

For nine LEDs belonging to group 1, the CPU 401 reads the data relating to the cumulative number of times of light emission of the target LED belonging to group 1 and the above-described lookup table, and determines the drive current value corresponding to the cumulative number of times of light emission of the target LED from the lookup table. Then, the CPU 401 outputs the determined drive current value to the drive unit, which drives each of the LEDs in group 1, as light amount control data. Each drive unit 405 driving the LEDs in group 1 supplies a drive current with a value that is based on the light amount control data output from the CPU 401 when pixel data that causes the LEDs to emit light is supplied from the data output adjustment unit 403. A light beam with a light amount based on the cumulative number of times of light emission of the target LED belonging to group 1 is emitted from the nine LEDs belonging to group 1. Since the light emission control of the LEDs belong to the other groups is the same, a description thereof will be omitted here.

When pixel data "1" is output from the data output adjustment unit 403 to the target LED, the CPU 401 adds 1 to the cumulative number of times of light emission read from the memory 404 so that the cumulative number of times of light emission of the target LED is increased by one.

(Image Data Shift)

Next, a configuration (image data shift) will be described for ensuring the accuracy of the light amount control of the light beams emitted by the LEDs other than the target LED that is performed as described above based on the cumulative number of times of light emission of the target LED of each group.

Figure 5A:
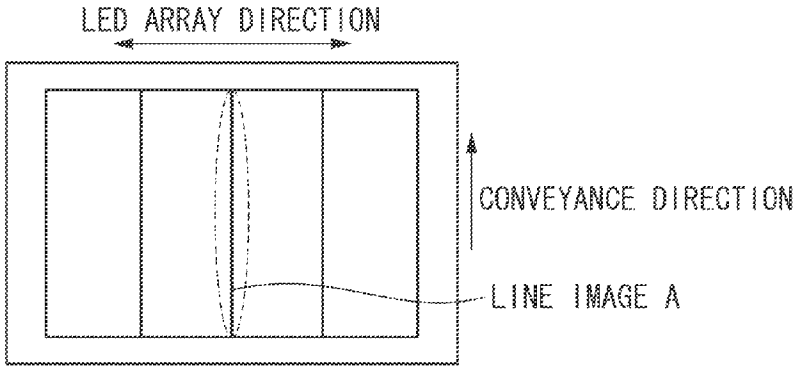
FIGS. 5A and 5B illustrate a relationship between an image on a sheet of recording paper and pixel data.
Figure 5B:
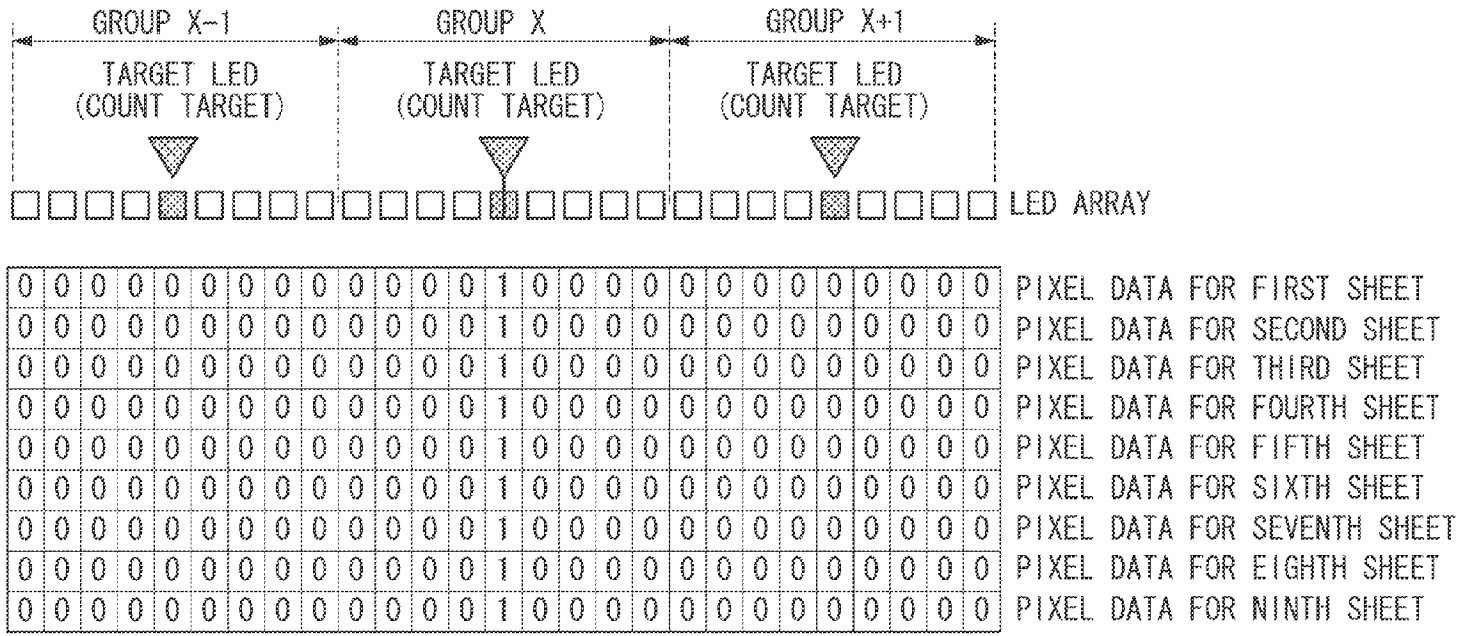

For example, FIG. 5A illustrates a frame border (ruled line) image formed on a sheet of recording paper. The line image A in FIG. 5A is a line image corresponding to the arrangement position of the target LED. As illustrated in FIG. 5B, by outputting pixel data "1" to the target LED belonging to group X and outputting pixel data "0" to the other LEDs, when a line image is formed on a plurality of sheets of recording paper with only the target LED, the cumulative number of times of light emission of the target LED increases by the number of pixels of the line image. However, since the LEDs other than the target LED belonging to group X do not emit light, the difference in the cumulative number of times of light emission between the target LED and the other LEDs increases.

To suppress the increase in the difference in the cumulative number of times of light emission between the target LED and the other LEDs that is caused by continuous formation of images, such as a ruled line, in the rotation direction of the photosensitive drum, the image forming apparatus according to the present exemplary embodiment executes a control like that described below.

Figure 6:
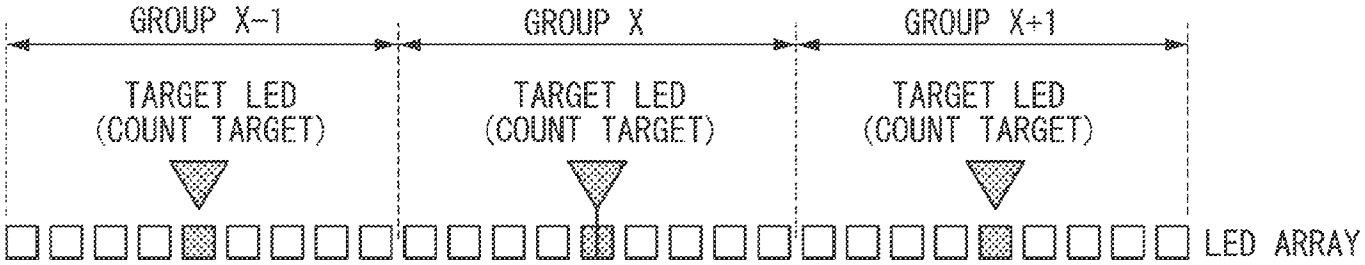
FIG. 6 illustrates a method of shifting pixel data.

Specifically, the image forming apparatus shifts the output destination of the pixel data of the whole image by one pixel in the main scanning direction each time an image is formed on one sheet of recording paper. For example, focusing on line image A, as illustrated in FIG. 6, the data output adjustment unit 403 shifts the pixel data output to the drive unit 405 in the main scanning direction so that the line image A is formed by a different LED for each sheet of recording paper. Since the shift amount and the shift direction of the image (electrostatic latent image) formed by each group illustrated in FIG. 6, such as group X−1, group X, and group X+1, are the same, the position of image formation in the main scanning direction on the recording paper is shifted by one pixel for each sheet of recording paper, and there is no change to the partial magnification of the image. Thus, by shifting the position of image formation in the main scanning direction in pixel units for each sheet of recording paper, the usage frequency of the plurality of light emitting elements within the group when continuously forming a ruled line, for example, can be made the same. Although FIG. 6 illustrates pixel data for forming an image on first to ninth sheets of recording paper, when forming an image on a tenth or subsequent sheet of recording paper, an image is formed on the tenth sheet of recording paper using the pixel data string of the first sheet illustrated in FIG. 6, and the position of the image formed on the eleventh and subsequent sheets of recording paper is shifted in the main scanning direction in the same manner as when forming the image on the first to ninth sheets of recording paper.

Although in the first exemplary embodiment an example is illustrated in which the image is shifted in units of one pixel, the shift amount of the image may be a predetermined number of two or more pixels. Further, although in the first exemplary embodiment an example is illustrated in which image shift is executed each time an image is formed on one sheet of recording paper, image shift can be executed each time an image is formed on a plurality of sheets of recording paper. In addition, while the position of image formation is different from the previous recording medium and the following recording medium when image shift is executed, by keeping the image shift amount to a level that cannot be visually perceived by a person, the mismatch in the position of image formation from the previous recording medium and the following recording medium can be visually suppressed.

Since the usage frequency among the plurality of light emitting elements can thus be brought closer, the occurrence of a large difference in the cumulative number of times of light emission of the target LED in the group and the cumulative number of times of light emission of the other light emitting elements can be reduced. By thus suppressing the light amount of each light emitting element in the group based on the cumulative number of times of light emission of the target LED in the group, the occurrence of a difference in the light amount of the light beam emitted from each light emitting element can be suppressed.

Figure 7:
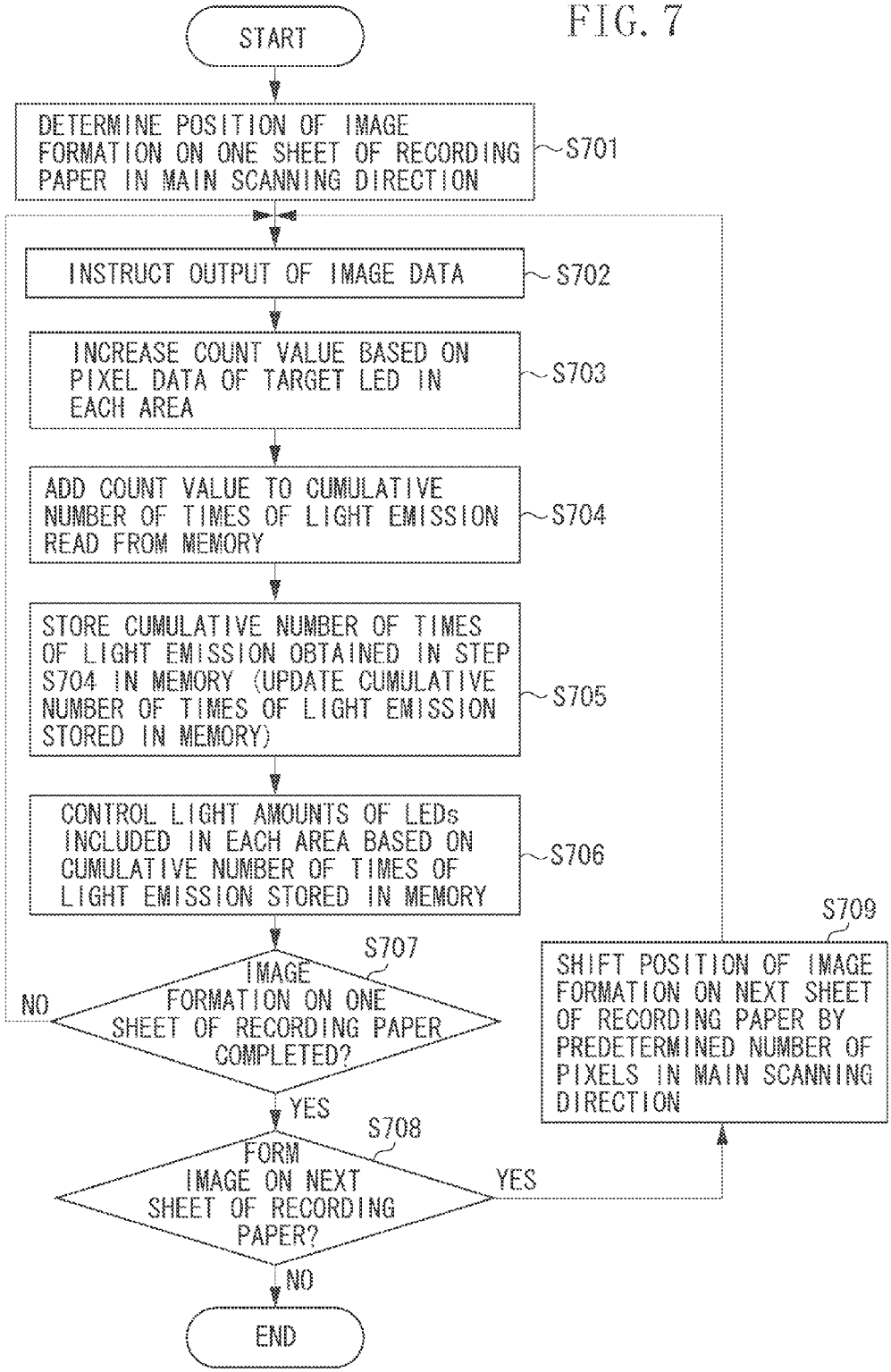
FIG. 7 is a flowchart illustrating a flow of control executed by a CPU.

FIG. 7 is a flowchart illustrating the control flow illustrated in FIGS. 4A and 4B that is executed during image formation by the CPU 401. The CPU 401 starts control based on the fact that pixel data has been output from the data generation unit 402 to the data output adjustment unit 403. First, in step S701, the CPU 401 determines the position of image formation on one sheet of recording paper in the main scanning position. Next, in step S702, the CPU 401 controls the data output adjustment unit 403 so that pixel data is output to the drive unit 405 based on the position of image formation in the main scanning direction determined in step S701. The drive unit 405 corresponding to each LED drives the LEDs based on the pixel data output from the data output adjustment unit 403.

In step S703, the CPU 401 increases a count value of an internal counter based on the pixel data output by the data output adjustment unit 403 to the drive unit 405 corresponding to the target pixel in each area. In the present exemplary embodiment, the CPU 401 internal counter increases the count value based on the fact that the data output adjustment unit 403 has output pixel data that makes each target pixel emit light.

Next, in step S704, the CPU 401 adds the count value obtained in step S703 to the cumulative number of times of light emission of each of the plurality of target LEDs stored in the memory 404, namely, the cumulative number of times of light emission of each of the plurality of target LEDs until the present control started. In step S705, the CPU 401 stores the cumulative number of times of light emission to which the count value was added in step S704 in the memory 404. Specifically, in step S705, the data relating to the cumulative number of times of light emission stored in the memory 404 is updated. Next, in step S706, the CPU 401 controls the light amount of the light emitting elements included in each group (the target light emitting pixel and the pixels other than the target light emitting pixel) based on the cumulative number of times of light emission of the target LED of each group that was stored (updated) in the memory 404 in step S705, and executes image formation.

Then, in step S707, the CPU 401 determines whether image formation on one recording sheet of recording paper has been completed. If it is determined in step S707 that image formation on one recording sheet of recording paper has not been completed (NO in step S707), the processing returns to step S702 to control formation of the next line in the sub-scanning direction.

On the other hand, if it is determined in step S707 that image formation on one recording sheet of recording paper has been completed (YES in step S707), the processing proceeds to step S708. In step S708, the CPU 401 determines whether to form an image on the next sheet of recording paper. If it is determined in step S708 to form an image on the next sheet of recording paper (YES in step S708), the processing proceeds to step S709. In step S709, the CPU 401 instructs the data output adjustment unit 403 to shift the position of image formation on the next sheet of recording paper by a predetermined number of pixels (in the present exemplary embodiment, one pixel) in the main scanning direction with respect to the position of image formation on the sheet of recording paper immediately before, and the processing returns to step S702. Then, the data output adjustment unit 403 adjusts (controls) the output of the pixel data to the drive unit 405 so that in step S709 the image will be formed at the instructed position.

If it is determined in step S708 not to form an image on the next sheet of recording paper (NO in step S708), the CPU 401 finishes the processing.

Thus, the image forming apparatus according to the present exemplary embodiment controls an increase in the difference between the cumulative number of times of light emission of the target LED and the cumulative number of times of light emission of the light emitting elements other than the target LED by shifting the position of image formation in the main scanning direction each time an image is formed on a predetermined number of sheets of recording paper. Since the occurrence of a difference in the cumulative number of times of light emission is suppressed, the light amount of the light emitting elements other than the target LED can be controlled based on the cumulative number of times of light emission of the target LED.

In the present exemplary embodiment, although data relating to the cumulative number of times of light emission of the target LED is illustrated as an example, the data stored by the memory 404 may be data relating to the cumulative duration of light emission of the target LED. In this case, the CPU 401 adds the duration of light emission based on the pixel data to the cumulative duration of light emission stored in the memory 404, and controls the light amount of each light emitting element based on the updated cumulative duration of light emission.

According to the exemplary embodiments of the disclosure, unevenness in the emitted light amount among a plurality of light emitting elements can be suppressed while cutting back on memory capacity.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2012-143142 filed Jun. 26, 2012, which is hereby incorporated by reference herein in its entirety.

What is claimed is:

1. An image forming apparatus configured to form an image on a recording medium by forming an electrostatic latent image on a rotating photosensitive member, developing the electrostatic latent image with toner, and transferring a toner image developed with toner from the photosensitive member onto the recording medium, the image forming apparatus comprising:

a light source that includes a plurality of light emitting elements configured to emit a light for exposing the photosensitive member, wherein the plurality of light emitting elements are arranged so as to respectively correspond to one pixel of the image in a direction of a rotational axis of the photosensitive member, wherein the plurality of light emitting elements are divided into a plurality of groups in the direction of the rotational axis of the photosensitive member, and an arbitrary one of the plurality of light emitting elements included to each group is a target light emitting element;

an output unit configured to output pixel data for driving each of the plurality of light emitting elements;

a drive unit configured to drive the plurality of light emitting elements based on the pixel data output from the output unit;

a storage unit configured to store a cumulative number of times of light emission of each of the target light emitting elements in each group; and a light amount control unit configured to control a light amount of the light emitting element which are in the group where each of the target light emitting elements is included, based on the cumulative number of times of light emission of each of the target light emitting elements stored in the storage unit.

2. The image forming apparatus according to claim 1 further comprising:

an output control unit configured to control output of the pixel data to the drive unit from the output unit so that a position of image formation of the electrostatic latent image is shifted in units of a predetermined number of pixels in the direction of the rotational axis of the photosensitive member each time an electrostatic latent image corresponding to a predetermined number of sheets of recording paper is formed.

3. The image forming apparatus according to claim 2, further comprising:

an update unit configured to, when the target light emitting element emit light based on pixel data that causes the target light emitting elements to emit light, update the cumulative number of times of light emission by adding the number of times of light emission by the target light emitting elements based on the pixel data to the cumulative number of times of light emission stored in the storage unit.

4. The image forming apparatus according to claim 2, wherein the output unit is configured to output either pixel data that causes the light emitting elements to emit light or pixel data that does not cause the light emitting elements to emit light.

5. The image forming apparatus according to claim 2, wherein the output control unit is configured to control output of the pixel data from the output unit so that a position of image formation of the electrostatic latent image is shifted in pixel units in the direction of the rotational axis of the photosensitive member each time an electrostatic latent image corresponding to one sheet of recording paper is formed.

6. The image forming apparatus according to claim 2, wherein the output control unit is configured to control output of the pixel data from the output unit so that a position of image formation of the electrostatic latent image is shifted in units of one pixel in the direction of the rotational axis of the photosensitive member each time an electrostatic latent image corresponding to one sheet of recording paper is formed.

7. The image forming apparatus according to claim 2, wherein the image forming apparatus is a color image forming apparatus comprising a plurality of light sources and a plurality of photosensitive members respectively corresponding to a plurality of toner colors, and wherein the output control unit is configured to output pixel data corresponding to each of the plurality of colors so that a shift direction and a shift amount of an electrostatic latent image formed on each photosensitive member in the direction of the rotational axis of the photosensitive members are the same.

8. An image forming apparatus configured to form an image on a recording medium by forming an electrostatic latent image on a rotating photosensitive member, developing the electrostatic latent image with toner, and transferring a toner image developed with toner from the photosensitive member onto the recording medium, the image forming apparatus comprising:

a light source that includes a plurality of light emitting elements configured to emit a light for exposing the photosensitive member, wherein the plurality of light emitting elements are arranged so as to respectively correspond to one pixel of the image in a direction of a rotational axis of the photosensitive member, wherein the plurality of light emitting elements are divided into a plurality of groups in the direction of the rotational axis of the photosensitive member, and an arbitrary one of the plurality of light emitting elements included in each group is a target light emitting element;

an output unit configured to output pixel data for driving each of the plurality of light emitting elements;

a drive unit configured to drive the plurality of light emitting elements based on the pixel data output from the output unit;

a storage unit configured to store a cumulative duration of light emission of each of the target light emitting elements in each group; and a light amount control unit configured to control a light amount of the light emitting elements which are the group where each of the target light emitting elements is included, based on the cumulative duration of light emission of each of the target light emitting elements stored in the storage unit.

9. The image forming apparatus according to claim 8 further comprising:

an output control unit configured to control output of the pixel data to the drive unit from the output unit so that a position of image formation of the electrostatic latent image is shifted in units of a predetermined number of pixels in the direction of the rotational axis of the photosensitive member each time an electrostatic latent image corresponding to a predetermined number of sheets of recording paper is formed.

10. The image forming apparatus according to claim 4, further comprising:

an update unit configured to, when the target light emitting elements emit light based on pixel data that causes the target light emitting elements to emit light, update the cumulative duration of light emission by adding the duration of light emission by the target light emitting elements based on the pixel data to the cumulative duration of light emission stored in the storage unit.

11. The image forming apparatus according to claim 9, wherein the output unit is configured to output either pixel data that causes the light emitting elements to emit light or pixel data that does not cause the light emitting elements to emit light.

12. The image forming apparatus according to claim 9, wherein the output control unit is configured to control output of the pixel data from the output unit so that a position of image formation of the electrostatic latent image is shifted in pixel units in the direction of the rotational axis of the photosensitive member each time an electrostatic latent image corresponding to one sheet of recording paper is formed.

13. The image forming apparatus according to claim 9, wherein the output control unit is configured to control output of the pixel data from the output unit so that a position of image formation of the electrostatic latent image is shifted in units of one pixel in the direction of the rotational axis of the photosensitive member each time an electrostatic latent image corresponding to one sheet of recording paper is formed.

14. The image forming apparatus according to claim 9, wherein the image forming apparatus is a color image forming apparatus comprising a plurality of light sources and a plurality of photosensitive members respectively corresponding to a plurality of toner colors, and wherein the output control unit is configured to output pixel data corresponding to each of the plurality of colors so that a shift direction and a shift amount of an electrostatic latent image formed on each photosensitive member in the direction of the rotational axis of the photosensitive members are the same.

* * * * *